US008282749B1

(12) United States Patent
Sabatini et al.

(10) Patent No.: US 8,282,749 B1
(45) Date of Patent: Oct. 9, 2012

(54) GREEN LIGHT EMITTING PYROTECHNIC COMPOSITIONS

(75) Inventors: Jesse J. Sabatini, Denville, NJ (US); Jay C. Poret, Sparta, NJ (US); Russell N. Broad, Passaic, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 13/155,480

(22) Filed: Jun. 8, 2011

(51) Int. Cl.

| | |
|---|---|
| ***C06B 43/00*** | (2006.01) |
| ***C06B 33/00*** | (2006.01) |
| ***D03D 23/00*** | (2006.01) |
| ***D03D 43/00*** | (2006.01) |

(52) U.S. Cl. ..... 149/22; 149/37; 149/109.2; 149/109.4

(58) Field of Classification Search ..... 149/22, 149/37, 109.2, 109.4
See application file for complete search history.

(56) References Cited

U.S. PATENT DOCUMENTS

| | | | | |
|---|---|---|---|---|
| 3,507,719 | A * | 4/1970 | Hodgson | 149/6 |
| 3,963,542 | A * | 6/1976 | Pilipovich | 149/19.3 |
| 6,427,599 | B1 * | 8/2002 | Posson et al. | 102/336 |
| 2009/0320975 | A1 * | 12/2009 | Shortridge et al. | 149/20 |

* cited by examiner

*Primary Examiner* — James McDonough
(74) *Attorney, Agent, or Firm* — Henry S. Goldfine

(57) ABSTRACT

Boron-containing, green light emitting pyrotechnic compositions that advantageously do not include barium, perchlorate or chlorinated organic compounds.

13 Claims, 2 Drawing Sheets

2(b)

2(a)

GREEN LIGHT EMITTING PYROTECHNIC COMPOSITIONS

UNITED STATES GOVERNMENT INTEREST

The inventions described herein may be manufactured, used and licensed by or for the U.S. Government for U.S. Government purposes.

FIELD OF THE DISCLOSURE

This disclosure relates generally to the field of pyrotechnics. More particularly, it pertains to improved green light emitting pyrotechnic compositions employing boron.

BACKGROUND OF THE DISCLOSURE

Light emitting pyrotechnics are an invaluable asset in a battlefield environment. In particular, light emitting pyrotechnics are advantageously used to signal battlefield status to troops. As a specific example, green light emitting pyrotechnics may signal to troops that it is safe to advance to another position.

Accordingly—given their military and/or industrial importance—new green light emitting pyrotechnic compositions would represent a significant advance in the art.

SUMMARY OF THE DISCLOSURE

An advance in the art is made according to an aspect of the present disclosure directed to new green light emitting pyrotechnic compositions and methods for their preparation. Advantageously, compositions according to the present disclosure do not include barium, perchlorate or chlorinated organic compounds.

More particularly—and in sharp contrast to prior art compositions that contain barium and generate green light with the formation of metastable barium (I) chloride (BaCl)—compositions according to the present disclosure emit green light with the controlled formation of metastable boron dioxide ($BO_2$).

Viewed from a first aspect, the present disclosure is directed to green light emitting compositions containing boron carbide, an oxidizer, and a suitable binder. Variations to this basic formulation include the addition of amorphous boron.

Viewed from another aspect, the present disclosure is directed to green light emitting compositions containing amorphous boron, crystalline boron, an oxidizer and a suitable binder.

Viewed from yet another aspect, the present disclosure is directed to green light emitting compositions containing amorphous boron, an oxidizer and a suitable binder.

Advantageously, compositions prepared according to the present disclosure do not contain barium or perchlorates and exhibit tunable burn characteristics.

BRIEF DESCRIPTION OF THE DRAWING

A more complete understanding of the present disclosure may be realized by reference to the accompanying drawings in which.

DETAILED DESCRIPTION

Figure 1:
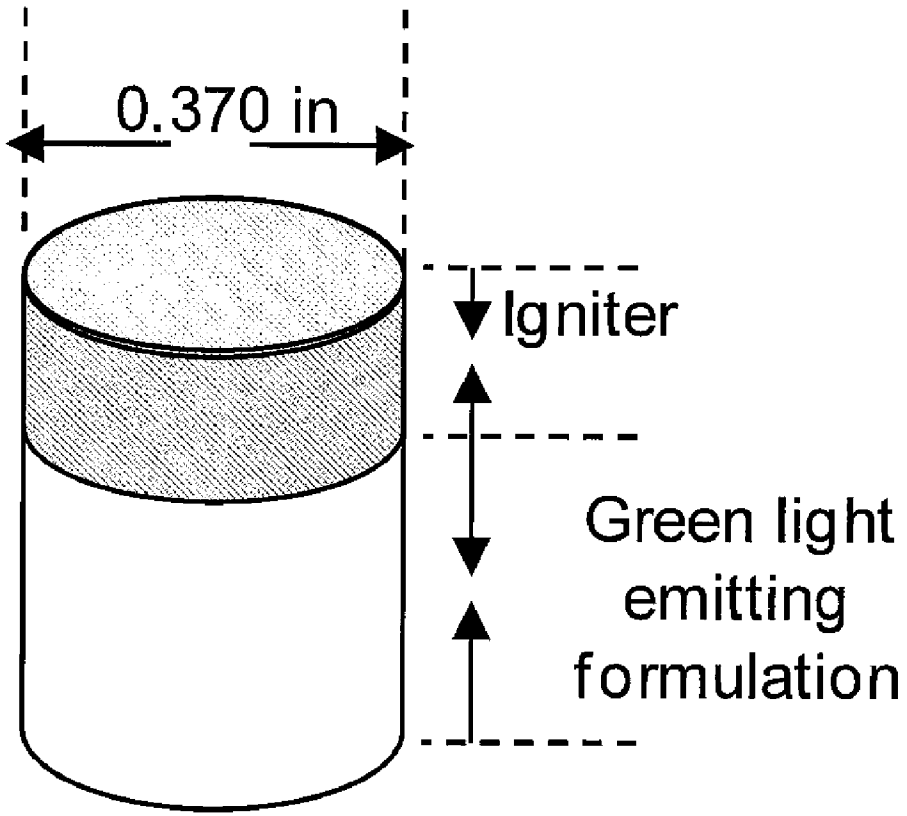
FIG. 1 is a schematic diagram showing the geometry of a green light emitting pyrotechnic pellet according to an aspect of the present disclosure.

The following merely illustrates the principles of the disclosure. It will thus be appreciated that those skilled in the art will be able to devise various arrangements, which, although not explicitly described or shown herein, embody the principles of the disclosure, and are included within its spirit and scope.

Furthermore, all examples and conditional language recited herein are principally intended expressly to be only for pedagogical purposes to aid the reader in understanding the principles of the disclosure and the concepts contributed by the inventor(s) to furthering the art, and are to be construed as being without limitation to such specifically recited examples and conditions.

Moreover, all statements herein reciting principles, aspects, and embodiments of the disclosure, as well as specific examples thereof, are intended to encompass both structural and functional equivalents thereof. Additionally, it is intended that such equivalents include both currently-known equivalents as well as equivalents developed in the future, i.e., any elements developed that perform the same function, regardless of structure.

Thus, for example, it will be appreciated by those skilled in the art that the diagrams herein represent conceptual views of illustrative structures embodying the principles of the disclosure.

With these principles in place, we may now describe the application of the present disclosure to the preparation of green light emitting pyrotechnic compositions and methods of preparation. However, it is useful to first review some additional background.

Contemporary green light emitting pyrotechnic compositions employ barium nitrate along with a chlorine donor to generate green light. Operationally, when barium and chlorine atoms combine at high temperatures the metastable BaCl ion molecular emitter is generated. Common, known formulations employing this mechanism include mixtures of 1) barium nitrate, magnesium, polyvinyl chloride (PVC) and suitable binder(s) (e.g., Laminac/Lupersol or any of a number of known polyester binder systems) and 2) barium nitrate, dechlorane plus, potassium perchlorate, magnesium and binder(s).

As noted previously, contemporary green light emitting pyrotechnic compositions produce the green light as a result of the formation of BaCl. Alternative green light emitting pyrotechnic formulations employing metastable boron dioxide anion ($BO_2$)—while known—introduce significant difficulties as the bum-time of boron-based pyrotechnics is difficult to control. According to the present disclosure however, a boron-based pyrotechnic with a tunable burn-time and sufficient green light output is prepared and described.

In a first composition, a mixture of substantially 10% amorphous boron, 85% potassium nitrate and 5% binder burned quickly and completely and generated a green light. As those skilled in the art will appreciate, amorphous boron exhibiting a non-crystalline atomic structure has been employed in the commercial pyrotechnics and propellant industries. One problem immediately encountered when using amorphous boron is its extremely fine particle size (generally <1 micron) and high material cost. Consequently, pyrotechnics employing such materials generally burn too quickly and are somewhat too sensitive to ignition. Despite these drawbacks, variations to the burn time and light output may be achieved by varying the ratio of the amorphous boron/oxidizer.

A second composition according to the present disclosure comprises a mixture of substantially 10% boron, 83% potassium nitrate and 7% binder. The boron component is a mixture of both amorphous boron and crystalline boron. The binder system comprised Epon 828 and Epikure 3140 curing agent in an 80/20 proportion. The general compositional outline for this second composition is shown in Table 1.

TABLE 1

Amorphous/Crystalline Boron General Pyrotechnic Formulations

| COMPONENT | FUNCTION | WEIGHT PERCENT |
|---|---|---|
| Potassium Nitrate | Oxidizer | 83 |
| Amorphous Boron | Fuel | 2-9 |
| Crystalline Boron | Burn Time Moderator | 1-8 |
| Epon 828/Epikure 3140 | Binder | 7 |

Combustion properties of this amorphous/crystalline boron pyrotechnic composition is shown in Table 2. As shown in Table 2, the combined boron content is held at 10% while the ratio of amorphous/crystalline boron is varied. As noted above, 7% of the binder (Epon 828/Epikure 3140 in an 80/20 proportion) and 83% $KNO_3$ is used.

TABLE 2

Amorphous Boron/Crystalline Boron Pyrotechnic Formulations

| Formulation Ratio (ab/cb) | Avg. Burn Time (sec) | Avg. Luminous Intensity (cp) | Avg. Dominant Wavelength (nm) | Avg. Spectral Purity (%) |
|---|---|---|---|---|
| Baseline | 8.78 | 816.90 | 562.30 | 66.40 |
| 100/0 | 2.39 | 1706.50 | 567.30 | 55.00 |
| 90/10 | 3.21 | 1580.60 | 564.60 | 54.70 |
| 80/20 | 4.01 | 1124.10 | 563.70 | 53.60 |
| 70/30 | 4.95 | 1608.00 | 562.90 | 52.80 |
| 60/40 | 6.27 | 1338.90 | 563.00 | 55.70 |
| 50/50 | 7.90 | 806.70 | 563.20 | 56.60 |
| 40/60 | 9.55 | 574.70 | 563.10 | 58.40 |
| 30/70 | 10.12 | 272.90 | 564.60 | 54.70 |
| 20/80 | 13.92 | 161.20 | 564.50 | 56.10 |

As may be readily appreciated by those skilled in the art, the amorphous/crystalline boron pyrotechnic compositions are advantageously tunable in that by changing the amorphous/crystalline boron ratio the light output and the burn time may be varied as desired or appropriate for a particular application.

With the compositions shown in Table 2, the amorphous boron acts as fuel, the potassium nitrate acts as an oxidizer, the crystalline boron acts as burn rate modifier and the Epon 828/Epikure 3140 acts as a binder. During combustion, the fuel and the oxidizer exothermically react to form metastable boron oxide—a green light emitter. With increased quantities of crystalline boron, burn time is increased and energy output from the formulation is decreased.

To evaluate these compositions—and by way of example only—each was pressed into pellets substantially 1.27 cm (0.5 in.) diameter by 2.54 cm (1 in) such as that shown in FIG. 1. The pellets were pressed with an 891 kg dead load (1963 lbs dead load at 10,000 psi) and weighed approximately 4 grams. To ensure consistent burn, the pellets were coated with an energetic slurry (A1A), which generates sufficient heat to initiate the chemical reaction. Electric matches were used to ignite the A1A slurry—which in turn—ignited the pellets.

Figure 2:
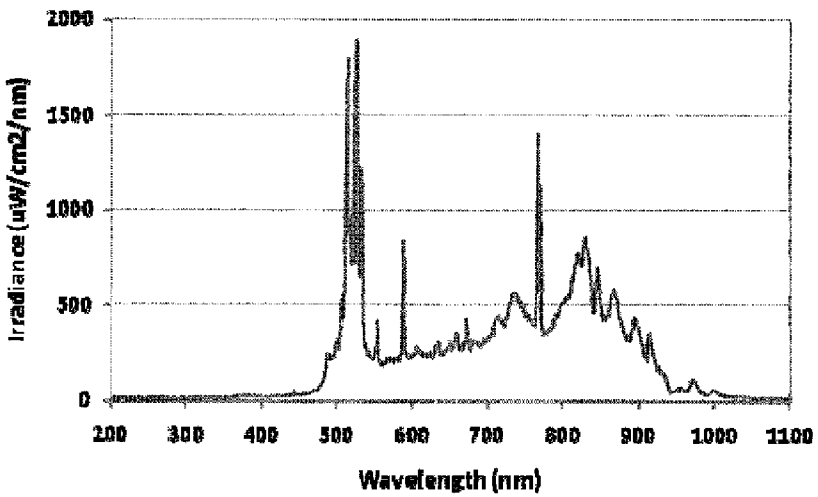
FIG. 2 shows the mid-bum spectral properties of FIG. 2*a*) boron based compositions according to the present disclosure and FIG. 2*b*) barium based compositions.
Figure 2:
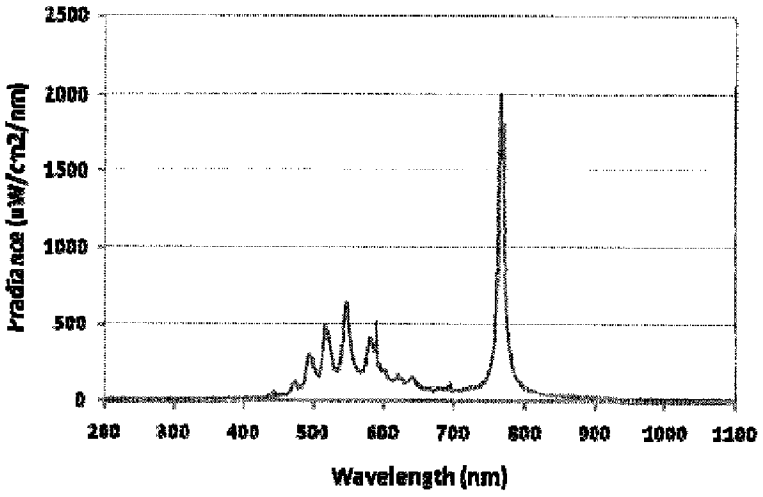

As already noted, boron serves as a fuel while the potassium nitrate serves as an oxidizer. When the mixture of these materials is exposed to a thermal stimulus, the resulting exothermic reaction produces $BO_2$, which produces green light in its metastable excited state, $BO_2$. FIG. 2 shows two spectra for both boron-based (2(*a*)) and barium-based formulations (2(*b*)). As may be observed from this FIG. 2, the barium-based composition exhibits a narrower green emission and a higher spectral purity and the boron-based compositions according to the present disclosure. More particularly, the barium-based compositions exhibit a dominant wavelength at approximately 558 nm while the boron-based compositions exhibit a dominant wavelength at approximately 562 nm. Notwithstanding these differences, there is minimal perceptible difference to the human eye in the green light output by the two compositions.

Another additional composition according to the present disclosure comprises a mixture of substantially 10% boron, 83% potassium nitrate and 7% binder. The boron component is a mixture of both amorphous boron and boron carbide. The binder comprised Epon 828 and Epikure 3140. The general compositional outline for this additional composition is shown in Table 3.

TABLE 3

Amorphous Boron/Boron Carbide General Pyrotechnic Formulations

| COMPONENT | FUNCTION | WEIGHT PERCENT (5) |
|---|---|---|
| Potassium Nitrate | Oxidizer | 83 |
| Amorphous Boron | Fuel | 0-5 |
| Boron Carbide | Fuel | 5-10 |
| Epon 828/Epikure 3140 | Binder | 7 |

With these additional amorphous boron/boron carbide compositions, the amorphous boron and the boron carbide serve as the fuel, potassium nitrate as the oxidizer and Epon 828/Epikure 3140 as the binder.

Combustion properties of these amorphous boron/boron carbide pyrotechnic compositions are shown in Table 4. As shown in Table 4, the combined boron content is held at 10% while the ratio of amorphous boron/boron carbide is varied. As noted above, 7% of the composition is binder (Epon 828/Epikure 3140) and 83% of the composition is $KNO_3$.

TABLE 4

Amorphous Boron/Boron Carbide Pyrotechnic Formulations

| Formulation Ratio (bc/ab) | Avg. Burn Rate (in/sec) | Avg. efficiency | Avg. Dominant Wavelength (nm) | Avg. Spectral Purity (%) |
|---|---|---|---|---|
| Baseline | 0.095 | 2972.2 | 562.0 | 0.604 |
| 50/50 | 0.117 | 3757.1 | 563.0 | 0.538 |
| 60/40 | 0.106 | 3491.0 | 562.6 | 0.535 |
| 70/30 | 0.079 | 3107.0 | 562.4 | 0.527 |
| 80/20 | 0.085 | 3740.6 | 562.8 | 0.531 |
| 90/10 | 0.075 | 2438.7 | 561.8 | 0.520 |
| 100/0 | 0.071 | 3367.1 | 561.4 | 0.520 |

Advantageously—and as is shown in Table 4—formulations comprising only boron carbide as fuel source, potassium nitrate as oxidizer, and a binder are realized according to this aspect of the present disclosure. As may be readily understood and appreciated by those skilled in the art, boron carbide is substantially less expensive than other sources of boron (e.g., amorphous boron). Consequently, green light emitting, boron-based pyrotechnics may be prepared utilizing only boron carbide as fuel. Accordingly, such compositions according to the present disclosure should exhibit wide military and industrial applicability.

A schematic diagram of a pyrotechnic pellet containing boron carbide according to an aspect of the present disclosure is shown in FIG. 1. As may be observed with continued reference to this FIG. 1, the boron carbide pyrotechnic pellet comprises an igniter portion (A1A) and a green-light emitting portion (i.e., Table 4 compositions). As with the compositions described previously, the igniter ensures reliable ignition of the green-light emitting portion.

At this point, while we have presented this disclosure using some specific examples, those skilled in the art will recognize that our teachings are not so limited. For example, any suitable oxidizer may be employed with our fuel formulations and any suitable binder system may be employed as well. More particularly, the binder systems used according to the present disclosure are preferably epoxy based, and it is noted that any suitable epoxy system may be employed as a binder. Other known polymeric formulations may be employed as well—depending upon their environmental impact. With respect to the oxidizer(s), it is explicitly noted that chlorate oxidizers—and in particular potassium chlorate—are suitable oxidizer replacements. In addition, while we have only shown very specific formulation ratios, they too may be varied as desirable to produce a green light and burn time(s) that match specific application requirements. Accordingly, the invention should be only limited by the scope of the claims attached hereto.

The invention claimed is:

1. A green light emitting pyrotechnic composition comprising:

a quantity of boron carbide;

a quantity of oxidizer which is substantially 83 wt % of the total composition; and a quantity of binder which is substantially 7 wt % of the total composition.

2. The green light emitting pyrotechnic composition of claim 1 further comprising a quantity of amorphous boron wherein the quantity of amorphous boron is substantially 0-5 wt % of the total composition and the quantity of boron carbide is substantially 5-10 wt % of the total composition.

3. The green light emitting pyrotechnic composition according to claim 1 further comprising a quantity of amorphous boron wherein the ratio of boron carbide to amorphous boron is one selected from the following: 50/50, 60/40, 70/30, 80/20, 90/10 and 100/0.

4. A green light emitting pyrotechnic composition comprising:

a quantity of a boron mixture including amorphous boron and crystalline boron;

a quantity of oxidizer; and a quantity of binder.

5. The green light emitting pyrotechnic composition of claim 4 wherein the boron mixture comprises substantially 10 wt % of the pyrotechnic composition, the oxidizer comprises substantially 83 wt % of the pyrotechnic composition and the binder comprises substantially 7 wt % of the pyrotechnic composition.

6. The green light emitting pyrotechnic composition of claim 5 wherein the boron mixture comprises substantially 2-9 wt % amorphous boron and 1-8 wt % crystalline boron.

7. The green light emitting pyrotechnic composition of claim 6 wherein the oxidizer is one selected from the group consisting of potassium nitrate and potassium chlorate.

8. The green light emitting pyrotechnic composition of claim 7 wherein the binder is epoxy based.

9. A green light emitting pyrotechnic comprising:

an igniter; and a quantity of boron carbide mixed with a quantity of amorphous boron to form a mixture, such that upon ignition of the igniter the mixture burns and emits green light.

10. The green light emitting pyrotechnic of claim 9 further comprising a quantity of ignition powder.

11. A green light emitting pyrotechnic comprising:

an igniter; and a mixture of amorphous boron and crystalline boron, such that upon ignition of the igniter the boron mixture burns and emits green light.

12. The green light emitting pyrotechnic of claim 10 further comprising:

a quantity of an oxidizer selected from the group consisting of potassium nitrate and potassium chlorate.

13. The green light emitting pyrotechnic of claim 10 further comprising an epoxy based binder.

* * * * *